US012509959B2

(12) United States Patent
Haugland

(10) Patent No.: US 12,509,959 B2
(45) Date of Patent: Dec. 30, 2025

(54) SYSTEM AND METHOD FOR PERMANENT PLUGGING OF A PETROLEUM WELL

(71) Applicant: Altus Intervention (Technologies) AS, Stavanger (NO)

(72) Inventor: Lasse Haugland, Bryne (NO)

(73) Assignee: Altus Intervention (Technologies) AS, Stavanger (NO)

( * ) Notice: Subject to any disclaimer, the term of this patent is extended or adjusted under 35 U.S.C. 154(b) by 0 days.

(21) Appl. No.: 19/020,455

(22) Filed: Jan. 14, 2025

(65) Prior Publication Data

US 2025/0146383 A1 May 8, 2025

Related U.S. Application Data

(62) Division of application No. 18/077,707, filed on Dec. 8, 2022, now Pat. No. 12,228,009.

(30) Foreign Application Priority Data

Dec. 10, 2021 (NO) ..... 20211489

(51) Int. Cl.
*E21B 33/134* (2006.01)

(52) U.S. Cl.
CPC ..... *E21B 33/134* (2013.01)

(58) Field of Classification Search
CPC ..... E21B 33/134
See application file for complete search history.

(56) References Cited

U.S. PATENT DOCUMENTS

| | | | |
|---|---|---|---|
| 5,390,737 | A | 2/1995 | Jacobi et al. |
| 2010/0122814 | A1 | 5/2010 | Picou |
| 2021/0372215 | A1 | 12/2021 | Lende et al. |

FOREIGN PATENT DOCUMENTS

| | | | | |
|---|---|---|---|---|
| GB | 2579473 | A | 6/2020 | |
| WO | WO-2021107785 | A1 * | 6/2021 | ..... E21B 33/13 |

* cited by examiner

*Primary Examiner* — Crystal J Lee
(74) *Attorney, Agent, or Firm* — GableGotwals

(57) ABSTRACT

A valve for a landing packer in a petroleum well. The landing packer is provided with a passage between an upper face and a lower face, and the valve is adapted to close the passage. The valve comprises a biased valve body adapted to be displaced between a first position and a second position. The valve body is adapted to receive a tool from above. The valve body is adapted to be displaced from a first position to a second position by a downward force executed by the tool. It is also described a tool comprising a leading end adapted to abut fluid tightly the biased valve body and the tool is adapted to displace the biased valve body between the first closed position and the second open position. It is also described a method for plugging the A-annulus in a petroleum well.

8 Claims, 6 Drawing Sheets

SYSTEM AND METHOD FOR PERMANENT PLUGGING OF A PETROLEUM WELL

CROSS REFERENCE TO RELATED APPLICATIONS

This application is a divisional application of U.S. Ser. No. 18/077,707 filed Dec. 8, 2022 which claims priority to Norwegian Patent Application No. 20211489 filed Dec. 10, 2021, each of which is incorporated herein by reference.

BACKGROUND OF THE INVENTION

The present invention relates to a method to establish a permanent well barrier using a wireline operated tool. The method comprises to dump a liquid sealant to form a plug across the cross section of the well. When a petroleum producing well ends the drainage period because it is not economical to continue production, the well is sidetracked or shut in temporary or permanently. Injection wells are treated the same way as petroleum producing wells when it's not economical to continue to produce from the field and there is no need for injection. The well is sidetracked or shut in temporary or permanently. In the end all petroleum wells need to be abandoned. Rules and regulations describe how this should be done, and the operation is referred to as plug and abandonment, P&A.

P&A is a complex operation and starts with individual planning customized to different complexity, different well completion etc. A permanent well barrier shall have the following characteristics:

- provide long term integrity;
- be impermeable;
- non-shrinking;
- able to withstand mechanical load/impact;
- resistant to chemical/substances;
- provide good bonding to steel and be non-harmful to the steel tubulars.

The steel tubular in a cross section of a permanent barrier needs to be supported by cement or a plugging material.

When an execution plan is approved, the operation can be performed. In many cases carrying out a P&A operation is done utilizing drilling rigs or workover rigs. Both alternatives represent substantial amount of equipment and personnel. If there aren't a drilling crew on the installation, the practice is to temporary shut in the well and perform P&A operation in a campaign at a later stage. Despite the high cost with today's technology, this is a cost-effective procedure. Over time and when several wells are temporary abandoned, a larger P&A campaign can be launched.

Drill pipe or snubbing normally remove the production tubing, either by pulling the whole tubing out of the well or milling away the production tubing. A column of cement is placed in the prepared area. A complete solid column and approved P&A barrier are then established over the required length and across the cross section of the drilled hole.

Temporary abandon a well could be to install a mechanical plug on wireline above the reservoir and below the production packer, and one shallow installed plug. When these wireline installed plugs are set and tested, the well can be shut in for several years before a P&A campaign is executed. A temporary shut in well has in most cases all its components intact, including all annuluses, tubing, x-mas tree, instrumentation, and flow lines. The well is monitored, and changes are registered.

Before the planned P&A campaign starts, the well(s) needs to be prepared. Often this is done using light well intervention equipment such as wireline operated equipment.

X-mas tree valves and instrumentation needs to function correctly. Installed plugs must be retrieved. Depending on circumstances additional wireline runs could be the result in this pre-P&A activity. Corrosion or other debris could complicate plug retrieving, and tubing could be severely corroded.

It is expensive but still cost effective with today's technology to temporary abandon petroleum wells, including monitoring and maintain the well equipment for years.

To generate an approved permanent barrier, installation of sealant material like cement is performed. Control lines and flatpacks attached onto the exterior of a production tubing represents a challenge. Flatpacks need to be addressed in the P&A program and handled accordantly.

If the well is straight forward constructed with a production/injection tubing, A-annulus and accepted casing cement, the operation may be performed by installing a cementing platform in the tubing, punching holes through the tubing wall to provide access to the A-annulus and a larger column of cement slurry may be pumped through a cementing string with standard wiper plugs separating the fluids. A larger column of sealant cement could be placed in the A-annulus and the tubing. Due to the substantial height of the cement column, such an installed plug is regarded as safe with sufficient integrity.

Cement bonding to steel, cavity space between tubings, purity of the sealant cement and sufficient volume of sealant cement are crucial for obtaining an accepted and trusted P&A barrier when leaving tubings in the well.

Good bonding of cement to steel requires a clean surface. After a long production period, the internal surface of a production tubing is in most cases not clean. Production debris like coating of wax or layer of scale are common, and in addition the tubing may be corroded. In other more special cases, the production tubing could have a protective liner to prevent corrosion and coating of wax or scale.

Sufficient cavity space between the external surface of the production tubing and the internal surface of the casing creates space for cement around the whole external surface of the production tubing. Within a deviating wellbore the production tubing will in most cases due to gravity rest on a low side and create a minimal space between the external surface of the production tubing and the internal surface of the casing on the low side. The casing is provided with centralizers on the external surface. The centralizers prevent the same narrow gap as between production tubing and internal surface of the casing.

Purity of sealant throughout the whole cement column requires spotting cement at the correct depth with trusted technology.

The only logging and quality control that may be performed is Cement Bond Logging of existing casing cementing before pumping and placing the final sealant cement. The final testing of an established plug and abandonment barrier are pressure tests and tagging test of the column top. The column height across the cross section of the well is regulated in standards and are normally minimum 50 meters. Known cementing technique used in the industry requires correct performance for optimal result. The cementing operation is qualified by a final pressure testing from the surface. Pressure testing is performed on cement in the annulus and on cement in the production tubing.

SUMMARY OF THE INVENTION

The invention has for its object to remedy or to reduce at least one of the drawbacks of the prior art, or at least provide a useful alternative to prior art.

The object is achieved through features, which are specified in the description below and in the claims that follow.

In the description and claims a landing packer is a plug provided with an arrangement for receiving and connecting a tool lowered down onto the plug.

The present invention relates to a plugging method for an A-annulus, a B-annulus and a production tubing in a petroleum well. The method utilizes a wireline operated device for transporting fluid plugging material, such as cement, into the well. More particularly the method utilizes a system according to the invention. In particular, the system comprises a valve for a landing packer adapted for forming a bridge plug in a petroleum well. More particularly, the landing packer is provided with a passage between an upper face and a lower face. The system comprises further a tool that engages fluid tightly with the valve. Even more particularly, the tool is adapted to open and close the valve. The tool comprises an internal compartment, and the leading end is adapted to form a liquid tight connection between the internal compartment and the passage in the bridge plug via an outlet in the leading end and an entrance in the valve. A pump in the tool is adapted to pump the fluid plugging material from the tool located in the production tubing through the valve and into the annulus. It is also described to increase the pressure in the well fluid surrounding the tool to assist the tool-string pump in pumping out the fluid plugging material through the valve.

The present invention relates to a device and a system for preparing and unloading liquid plugging material in a well. More specifically the invention relates to a special displacement dump bailer for insertion sealant into a well in the ground wherein the displacement bailer comprises a receptacle which communicates with the surroundings through an outlet and an inlet. An internal pump assisted by increased tubing pressure squeeze the content in a displacement bailer out and into a prepared well and preinstalled installation in the well. A homogenous column of sealant is formed.

When a petroleum well on an installation has produced it's potential, it is possible with the wireline P&A arrangement according to the invention, to execute a proper P&A program thereby omitting the temporary abandonment operation. Expensive work over rigs and drilling rigs can be used effectively drilling for new production zones and only be used removing extremely heavy equipment from wells that are not possible to handle by a wireline operation. A proper wireline performed P&A operation (WL P&A) according to the invention reduces the expensive monitoring activity and the temporary pre-P&A activity as well.

One advantage of the invention is that the WL P&A operation may be performed when there is available space for extra personnel onboard. Thereby, the installation's production capability is not reduced, and possible conflicts during other hectic periods onboard are avoided as well.

Preparation of the target area, i.e., the area where the casing cement is accepted, will be a major part of establishing an approved P&A barrier across the cross section of the well. This activity is critical and important for the integrity and quality of the barrier. After barrier material like cement is placed in a large column, the quality check is limited leaving the result to two simple permanent barrier qualification tests: i) Tagging the cement in the tubing; ii) Pressure test from above in the annulus and in the tubing.

Candidate wells to be plugged and abandoned according to the present invention, are wells that have a solid and approved casing cement bonding. In addition, the production tubing shall not be provided with external electrical wires, tubes and solid wire, known as flat pack, on the exterior of the production tubing.

The target area can be prepared by a wireline operation prior to cementing. Typical activities could be:

- Logging the internal surface of the production tubing to verify the condition and to spot if there are coating or other obstacles present which will hinder the cementing. This can typically be done by running simple drift run on wireline, or run a more advanced logging tool like Multifinger imaging tool (MIT).
- Cleaning of the chosen area by scale milling or by brushing using a wireline tractor or mechanical brushing up and down at the target area. The advantage using Powered Mechanical Application (PMA) is that effective cleaning may be performed only at the target area. Typically, wireline cleaning and debris removal may be performed simultaneously. The debris may be collected or injected.
- Punching or radial drilling of holes in the tubing wall for liquid communication from within the tubing to the A-annulus may be performed by a wireline operation after the cleaning. Cleaning and punching may be performed on the same run by a combination of tools in the tool-string. Punching or radial drilling of holes in the tubing wall may be performed on wireline after installing a plug in the tubing to form a cementing platform. Plug setting and punching may be performed on the same run by a combination of tools in the tool-string. Fluid in the A-annulus may be injected into the reservoir if the holes in the tubing wall are established before setting the cementing platform in the tubing. Injection of cleaning fluid from the surface, down the A-annulus and into the production tubing and away, may improve the cleaning process later in the program.

Installation of the cementing platform in the tubing may be a standalone activity performed as a wireline operation. As an alternative, the installation of the cementing platform may be performed in a combination run performed as a wireline operation. The cementing platform is typical a mechanical plug with an anchoring element and an elastomer element. After the acceptance of the pressure test, circulation of cleaning fluid may be performed.

Different cleaning fluid may be used depending on the conditions. The direction of the fluid cleaning flow may be down in the A-annulus and up in the tubing. The direction of the fluid cleaning flow may be down in the tubing and up in the A-annulus. If a high flow rate is required, larger communication holes between the tubing and the A-annulus may be produced.

In most cases the production tubing is not provided with external centralizers to prevent contact between the production tubing and the casing. The production tubing may in most cases, due to gravity, lie in contact with the casing on the low side. The cement will then not flow in between the production tubing and the casing and so-called micro annuli may be created after cementing. Micro annuli may lead to poor cement bonding. Non-acceptance of a performed A-annulus cementing operation is then a potential risk.

Different technics may be used to increase the distance between the production tubing and the casing in a deviating well to create space and leading to better cement bonding. Prior to cementing a wireline dimple tool may be run. A high-power expansion tool may be equipped with a dimple element. Dimples may be formed over the entire length of the planned cementing area. Dimpling the production tubing from the inside will create an internal dent and an external bulging. The external bulging forms a clearance and makes space for cement. The bulged exterior of the production tubing lifts the production tubing up from the internal surface of the casing. Contact is only by contact points, thereby avoiding longitudinal pipe section contacts.

As an alternative or as a supplement, vibration may also be used to fill the gap on the low side with cement. Vibration may at least help filling the entire volume in the A-annulus.

Cementing the different cavities stepwise provides higher quality control of the result. A Cement Bond Log (CBL) tool run on wireline will verify the cement bonding to steel and also verify sufficient height of the cementing column in the annulus.

After CBL has verified good integrity and solid bonding to steel in the annulus, the remaining activity for establishing a plug across the cross section of the well is dumping cement in the tubing. The activity of dumping cement in the tubing may be performed as disclosed in U.S. Pat. No. 345,731B1.

Cementing inside the production tubing using a dump bailer system on wireline on top of the cementing platform or on top of the annulus injection valve, is done from bottom and upwards. Every new load is carefully placed on top of the previous load or injected into the top of previous load. Placing a new load of cement without any mixture or contamination of the cement is disclosed in the U.S. Pat. No. 345,731B1.

Carrying cement in a sealed and pressure compensated compartment inside a dump bailer provides transport of cement from the surface down to the injection valve or down to the previous dumped load of cement. Contamination and influx of other substances is avoided, providing a homogeneous column of cement in both the annulus and within the tubing.

Cement bond logging (CBL) after cementing of the A-annulus will quality check the cementing operation, i.e., the bonding and the height of the cement column placed in the A-annulus. The same CBL logging will provide feedback if the B-annulus has sufficient cement bonding or disclose if there is a need for cementing the B-annulus.

B-annulus cementing can utilize the same technic as cementing of the A-annulus, but needs to be performed after completion of the A-annulus cementing. After the A-annulus cement has cured, new holes may be radially drilled through the production tubing wall, the cured cement in A-annulus, and the casing, into the B-annulus. When sufficient communication volume/flow rate has been verified between the B-annulus and the production tubing through this communication port, the B-annulus may be cleaned by circulation of cleaning fluid. A landing packer with an injection valve is positioned in the production tubing, and cementing may be performed. The production tubing is filled with cement up to the communication port prior to installing the injection valve. Cement is pumped into the B-annulus through the injection valve.

After completion of the cementing operation of the B-annulus, a new CBL may be run to verify the cement bonding to steel and the height of the cement column in both the A-annulus and the B-annulus. Thereafter, the production tubing is filled with cement on top of the injection valve. This finalizes the cementing operation.

Strength, impermeability, absence of fractures and faults are crucial properties of a cement barrier. The invention improves these properties by keeping the cement clean until unloading, and cement is added to cement unloaded in the previous run without mixing in well fluid in the cement. According to the invention, verification of the cementing operation is done stepwise during the operation.

Dumping of cement from the dump bailer is controlled by a tool operator at the surface. Dumping of cement can only be performed when a tool pump is activated. The system has also full volume control. If the pump stops in the middle of an operation, the remaining cement within the bailer will be locked until re-activation of the pump.

When all cement has been pumped out from the dump bailer, a floating piston dividing cement and well fluid within the dump bailer, will reach a chamber bottom and a pump pressure will spike. The floating piston blocks the outlet completely, thereby avoiding pumping well fluid into the cement and contaminating the cement.

Cement is forced out of the dump bailer by the pump inside the wireline tool-string. Well fluid from the surrounding enters the dump bailer on top of the piston. The pump creates an overpressure which open the dump bailer piston valve at the bottom part of the dump bailer. This bottom part piston valve is a spring-closed valve and may only be opened by overpressure created by the tool-string pump.

If the pump cannot deliver sufficient pressure to squeeze cement through the landing packer and the injection valve and into the annulus, increasing the surrounding pressure in the production tubing will assist and secure sufficient squeeze pressure. If the bailer is unintentionally lifted off and up from the landing packer, the injection valve closes, thereby avoiding influx of surrounding well fluid into the cement.

The carrying capacity of a wireline operated dump bailer is limited. Repetitive runs with cement are necessary to supply sufficient amounts of cement to the A-annulus and to the cement the tubing. Due to landing packer and the injection valve, unwanted influx of well fluid to the cement is avoided. Additional loads can be placed without mixing and contamination.

Volume capacity of the dump bailer must be calculated for each case. Well restriction, length of pressure control equipment, and cable strength, are typical parameters to consider. The volume required and the configuration of the tool-string dictate number of runs with concrete. Typical 50-200 litre of cement per run can be handled when the production tubing is 14.0 cm or 17.8 cm (5½" or 7").

Cement curing time is a factor when cementing in the annulus. The reason for this is cement is injected from bottom and upwards. To avoid cement curing before sufficient volume is in place, retardants are added to the cement slurry.

Unforeseen delay in all operation may occur and hinder completing the annulus cementing operation from one injection valve. If the cement cures unintentionally in the annulus, the operation can be restarted by installing a new landing packer and injection valve higher up in the production tubing.

The invention is defined by the independent patent claims. The dependent claims define advantageous embodiments of the invention.

In a first aspect the invention relates more particularly to a valve for a landing packer. The landing packer is adapted for forming a bridge plug in a petroleum well. The landing packer is provided with a passage between an upper face and a lower face, and the valve is adapted to close the passage. The valve comprises a biased valve body adapted to be displaced between a first position and a second position. The valve body is adapted to liquid tight close an entrance to the passage when in the first position. The valve body is adapted to open the entrance when in the second position. The valve body is adapted to receive a tool from above. The valve body is adapted to be displaced from the first position to the second position by a downward force executed by the tool. The valve body is adapted to be displaced to the first position when the downward force ceases.

In one embodiment the valve body may comprise a sleeve. In one embodiment the valve may comprise a spring which biases the valve body towards the first position.

In a second aspect the invention relates more particularly to a tool adapted for displacement in a petroleum well. The tool comprises a leading end adapted to abut fluid tightly a biased valve body of a valve positioned on a landing packer, and the tool is adapted to displace the biased valve body between a first closed position and a second open position by a downward force executed by the tool.

The tool may in one embodiment according the second aspect comprise an internal compartment, and the leading end may be adapted to form a liquid tight connection between the internal compartment and a passage in the bridge plug via an outlet in the leading end and an entrance in the valve.

The tool may be:

operated by a wireline;

provided with a pump at an upper end;

provided with a fluid connection between a suction side of the pump and a surrounding of the tool; and provided with an outlet valve between the compartment and the outlet.

In one embodiment according to the second aspect, the compartment may be provided with a wiper plug.

In one embodiment the outlet valve may be a check valve. This has the advantage that fluid in the petroleum well cannot enter the compartment via the outlet and thereby pollute or interfere with the content in the compartment.

In a third aspect the invention relates more particularly to a system for plugging a petroleum well with a fluid plugging material, the system comprises:

a valve for a landing packer adapted for forming a bridge plug in the petroleum well, the landing packer is provided with a passage between an upper face and a lower face, the valve is adapted to close the passage, and a tool adapted for displacement in a petroleum well, the tool comprises a leading end.

The valve comprises a biased valve body adapted to be displaced between a first position and a second position;

in the first position the valve body closes liquid tight an entrance to the passage, and in the second position the entrance is open.

The valve body is adapted to receive a tool from above.

The valve body is adapted to be displaced from the first position to the second position by a downward force executed by the tool.

The valve body is adapted to be displaced to the first position when the downward force executed by the tool is removed.

The tool is adapted to abut fluid tightly the biased valve body, and to displace the biased valve body between a first closed position and a second open position by the downward force executed by the tool.

According to an embodiment of the third aspect, the valve body may comprise a sleeve. In one embodiment the valve may comprise a spring which biases the valve body towards the first position.

The tool may in one embodiment according to the third aspect comprise an internal compartment, and the leading end may be adapted to form a liquid tight connection between the internal compartment and a passage in the landing packer via an outlet in the leading end and an entrance in the valve.

The tool may be:

operated by a wireline;

provided with a pump at an upper end;

provided with a fluid connection between a suction side of the pump and a surrounding of the tool; and provided with an outlet valve between the compartment and the outlet.

In one embodiment according to the third aspect, the compartment may be provided with a wiper plug.

In one embodiment according to the third aspect, the outlet valve may be a check valve.

The system may comprise a driving unit for displacement of the tool within the petroleum well.

In a forth aspect the invention relates more particularly to a method for plugging an A-annulus in a petroleum well, the method comprises the steps of:

position a bridge plug in a production tubing;

provide openings in the production tubing above the bridge plug to create a fluid communication between the production tubing and an A-annulus formed between the production tubing and a casing;

position a landing packer within the production tubing and above the openings;

provide a tool comprising a dump bailer;

provide a valve as described above;

provide a tool as described above, and repeatedly perform the sequence of steps:

land the tool on the valve;

open the valve body by a downward force executed by the tool and establish a fluid tight conduit between the compartment and the passage;

start the pump to increase the pressure inside the compartment;

open the outlet valve by the increased pressure;

pump fluid plugging material from the compartment via the outlet valve, outlet, entrance, passage, and openings into the A-annulus until the compartment is empty for fluid plugging material;

stop the pump;

displace the tool upwards such that the valve body returns to the first position; and displace the tool to the surface, until the A-annulus is filled with a desired amount of fluid plugging material.

The method may comprise to increase a pressure of the well fluid within the production tubing, thereby increasing the pressure on a suction side of the pump and obtain a higher pressure on the pressure side of the pump for pumping the fluid plugging material into the A-annulus.

The fluid plugging material may be cement.

BRIEF DESCRIPTION OF THE DRAWINGS

In the following is described an example of a preferred embodiment illustrated in the accompanying drawings, wherein.

DETAILED DESCRIPTION OF THE INVENTION

Figure 1:
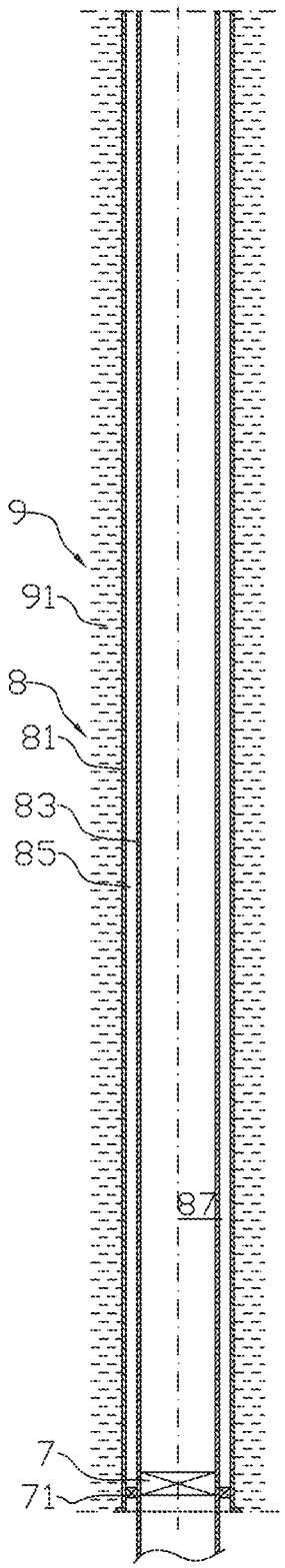
FIGS. 1-10 show schematically according to the invention a sequence of preparing a well in the ground, and fill an annulus and a tubing of the well with plugging material delivered by a wireline operated dump bailer.

Identical reference numerals indicate identical or similar features in the drawings. The drawings are presented in a simplified and schematic manner, and the features therein are not necessarily drawn to scale. In the figures, same or corresponding elements are indicated by same reference numerals. For clarity reasons, some elements may in some of the figures be without reference numerals. A person skilled in the art will understand that the figures are just principal drawings. The relative proportions of individual elements may also be distorted.

Any positional indications refer to the position shown in the figures. As used here, the terms "up" and "down"; "upper" and "lower"; "upwardly" and "downwardly"; "below" and "above"; and other similar terms indicating relative positions above or below a given point or element may be used in connection with some implementations of various technologies described herein.

In the following description, numerous details are set forth to provide an understanding of the present invention. However, it will be understood by those skilled in the art that the present invention may be practiced without these details and that numerous variations or modifications from the described embodiments are possible.

Figure 2:
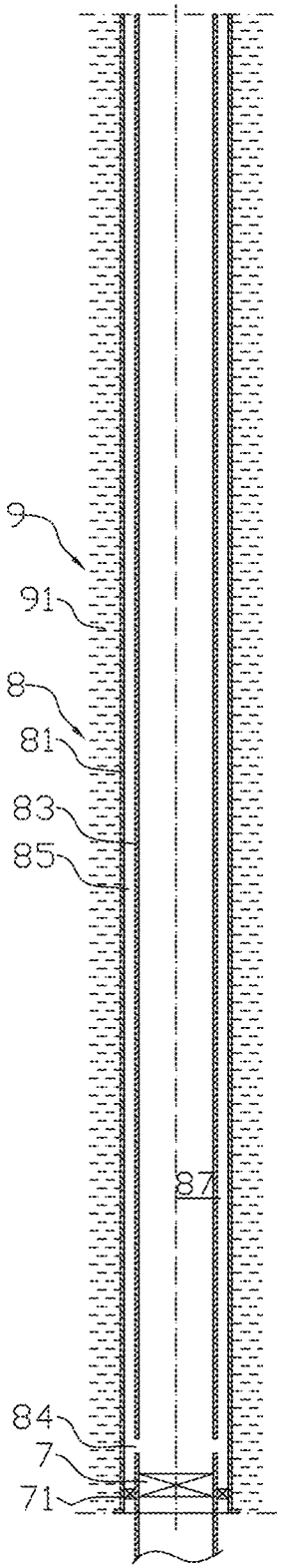

In the drawings, the reference numeral 9 indicates a well bore in a ground 91. The well bore 9 is provided with a petroleum well 8. FIGS. 1 and 2 show schematically a petroleum well 8 as known in the art. The petroleum well 8 comprises a casing 81 and a production tubing 83. The casing 81 and the production tubing 83 form between them an annulus. The annulus is herein termed the A-annulus 85. In a lower end the tube is sealingly closed by a bridge plug 7. The A-annulus 85 is in a lower end sealingly closed by a production packer 71 for the purpose of providing a seal between the outside of the production tubing 83 and an inside of the casing 81. The production packer 71 forms a platform when installing an approved P&A barrier in the A-annulus. The A-annulus 85 is filled to a required height with a curable fluid plugging material 6, such as cement. The production tubing 83 has been provided with a number of holes above the bridge plug 7. The holes create an opening 84 between the internal space of the production tubing 83 and the A-annulus 85.

A landing packer 2 has been provided with a valve 1 according to the invention, as seen in FIGS. 3-10. The landing packer 2 is set in a fluid tight manner above and in the vicinity of the opening 84 at the lower portion of the production tubing 83. It is well known in the art how to set such a landing packer 2, and this is not described further.

Figure 3:
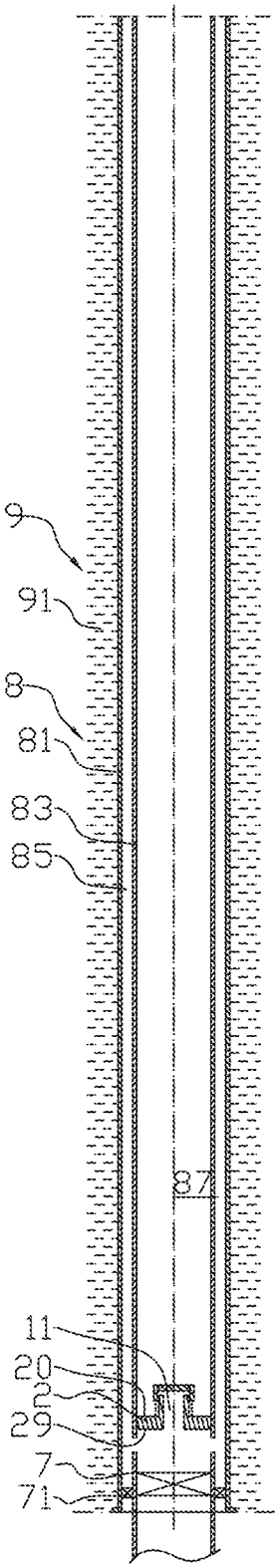
Figure 4:
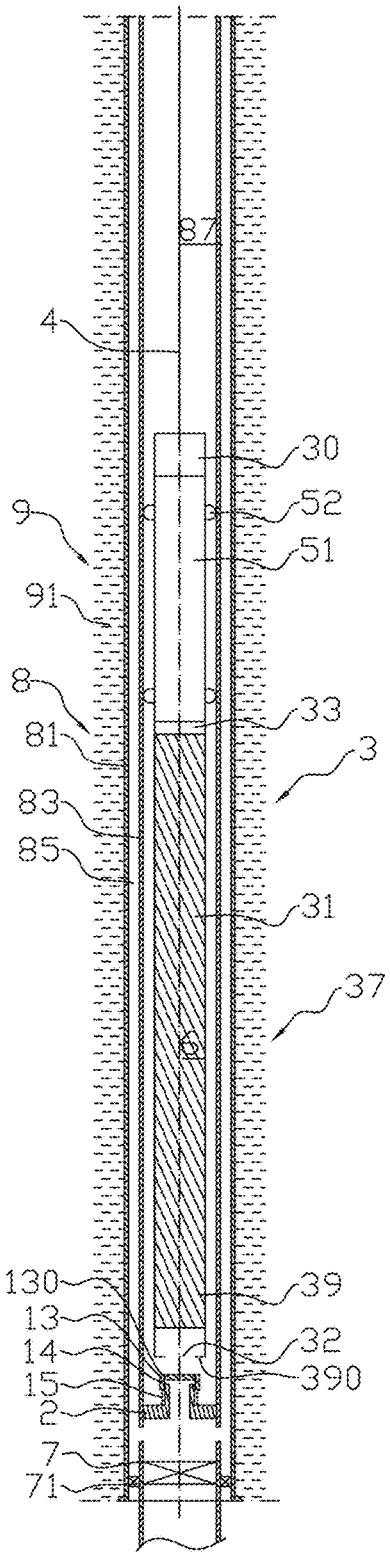
Figure 12:
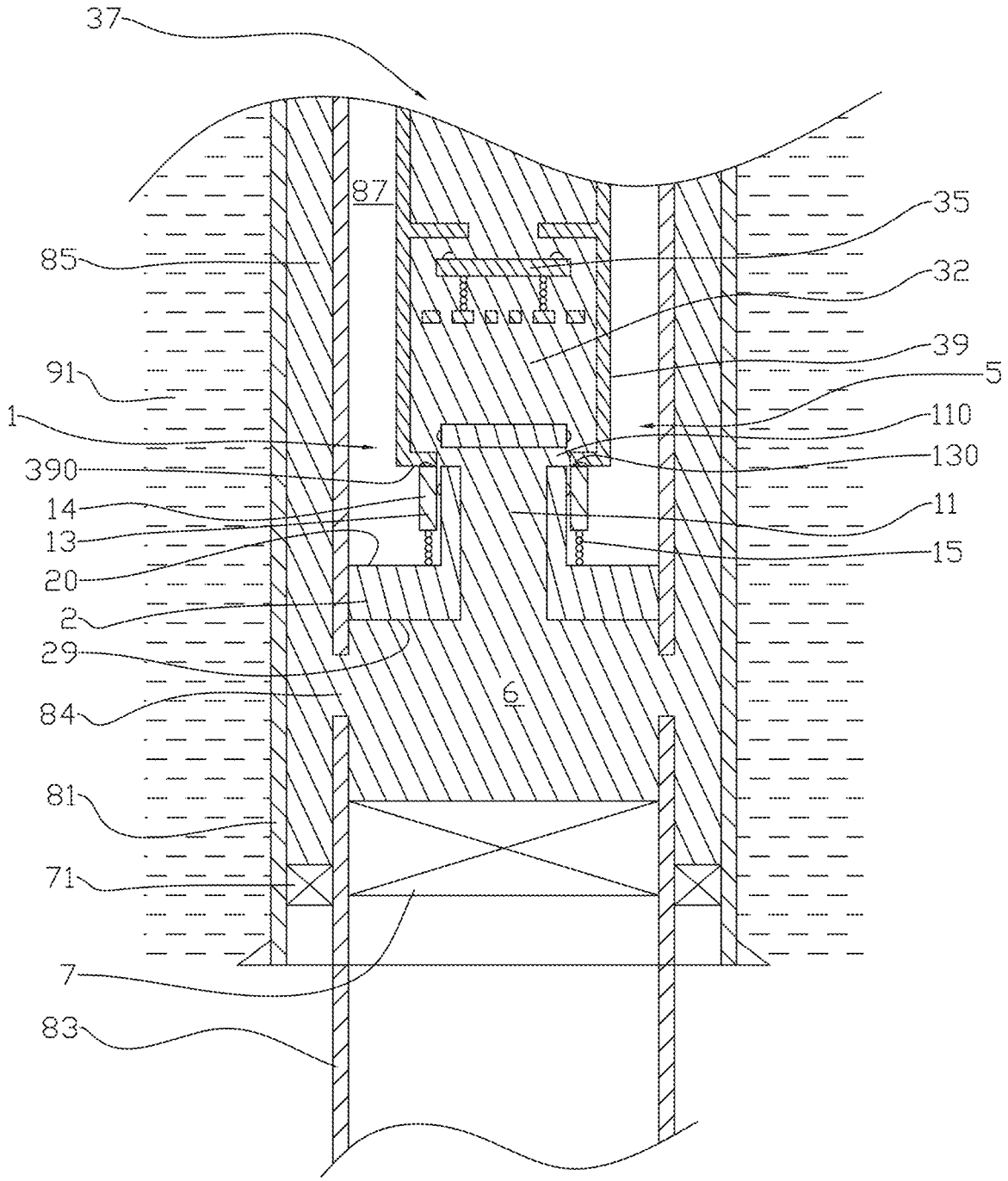
FIG. 12 shows an enlarged part of FIG. 6.

The landing packer 2 is provided with a passage 11 between an upper face 20 and a lower 29 face as shown in FIGS. 3 and 12 only. The valve 1 comprises an entrance 110 (see FIG. 12) between the passage 11 and the internal space of the production tubing 83. The valve 1 comprises a biased valve body 13. The biased valve body 13 is shown as a sleeve 14 that surrounds the entrance 110. A spring 15 exerts an upward force on the biased valve body 13, 14. The valve 1 is configured to be tight when the valve body 13 is in a closed position as shown in FIG. 4. I.e., the valve body 1 seals the passage 11. The valve body 13 comprises a landing face 130.

A tool 3 is adapted to transport a fluid plugging material 6 from a surface (not shown) to the lower part of the production tubing 83. The tool 3 is shown as a wireline operated tool 3 and is connected to the surface via a wireline 4. Such a wireline 4 is known in the art and is not described further. The tool 3 forms an upper end 30 and a lower leading end 39 as shown in FIG. 4. The tool 3 comprises a compartment 31 that is filled with the fluid plugging material 6 at the surface, and the fluid plugging material 6 is emptied within the internal space of the production tubing 83, as will be described later. The tool 3 is provided with an outlet 32 in the leading end 39. The leading end 39 forms a contact face 390 as best seen in FIG. 12.

Figure 11:
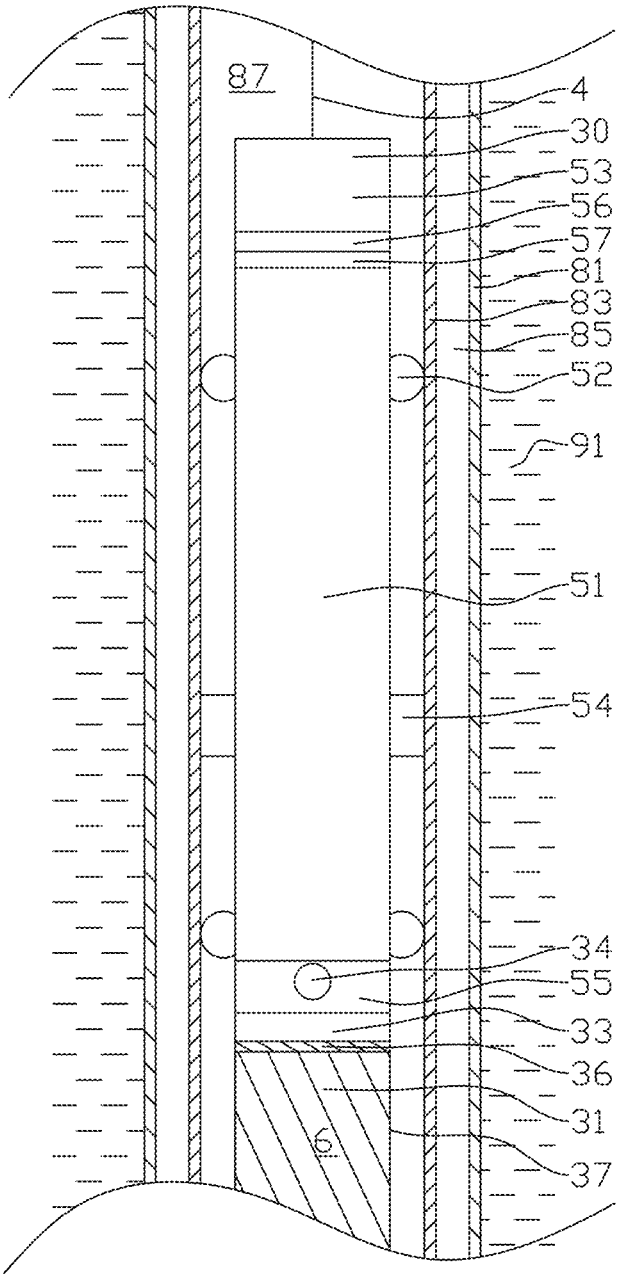
FIG. 11 shows schematically an enlarged part of the tool.

The upper end 30 is shown in more details in FIG. 11. The tool comprises a driving unit 51. The driving unit 51 may be a wireline operated tractor as known in the art. The wireline 4 is connected to the driving unit 51 with a cable head 53. A swivel 56 and a depth correlation tool (CCL) 57 are also included between the cable-head 53 and the driving unit 51. A rotational motor arrangement drives a dump bailer pump system. The tool-string could also include a stroker tool. The stroker could anchor the tool in the production tubing 83 securing the position of the dump bailer 37 from operation dump sequence start and throughout the whole unloading sequence. The stroker could include a tractor drive section. Both the wireline tractor and the wireline stroker could be left out from the arrangement on some occasions. A motor driven pump 33 is positioned between the cable head 53 and the compartment 31. The pump 33 is on a suction side in fluid connection with a well fluid 87 within the production tubing 83 via a fluid connection 34. The compartment 31 is provided with a wiper plug 36. The pressure side of the pump 33 is open towards the upper side of the wiper plug 36.

The leading end 39 is shown in more details in FIG. 12. An outlet valve 35 closes the compartment 31 at the lower end of the compartment 31 and forms a barrier between the compartment 31 and the outlet 32. In FIG. 12 the outlet valve 35 is shown as a check valve in an open position.

The compartment 31 is filled with fluid plugging material 6 at the surface and the tool 3 is then lowered in the production tubing 83 as seen in FIG. 4. The tool 3 forms a dump bailer 37. The tool 3 is lowered via the wireline 4 until the contact face 390 of the leading end 39 abuts the landing face 130 of the biased valve body 13. A further downward displacement of the tool 3 displaces the biased valve body 13 from a closed position to an open position as seen in FIGS. 5 to 7, 9, and 12. The downward displacement may be due to the weight of the tool 3 itself. In an alternative embodiment, the displacement may be due to the weight of the tool 3 and in addition by a downward force created by propulsion organs 52 on the driving unit 51. In an alternative embodiment the driving unit 51 is anchored to the production tubing 83 by anchors 54 as shown in FIG. 11. The driving unit 51 is provided with a stroker (not shown) which may displace the compartment 31 downwards.

Figure 5:
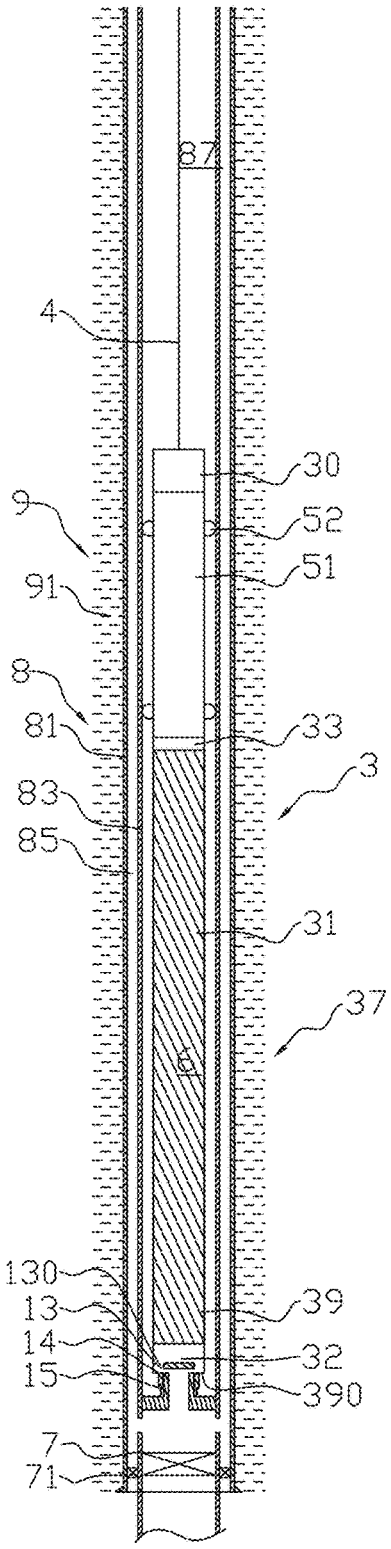
Figure 6:
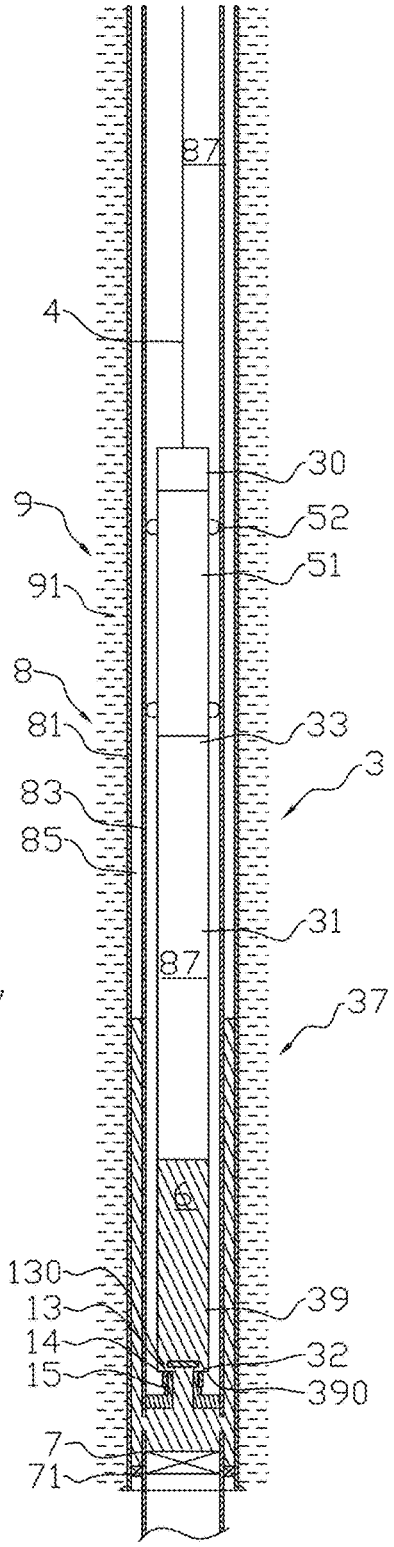
Figure 7:
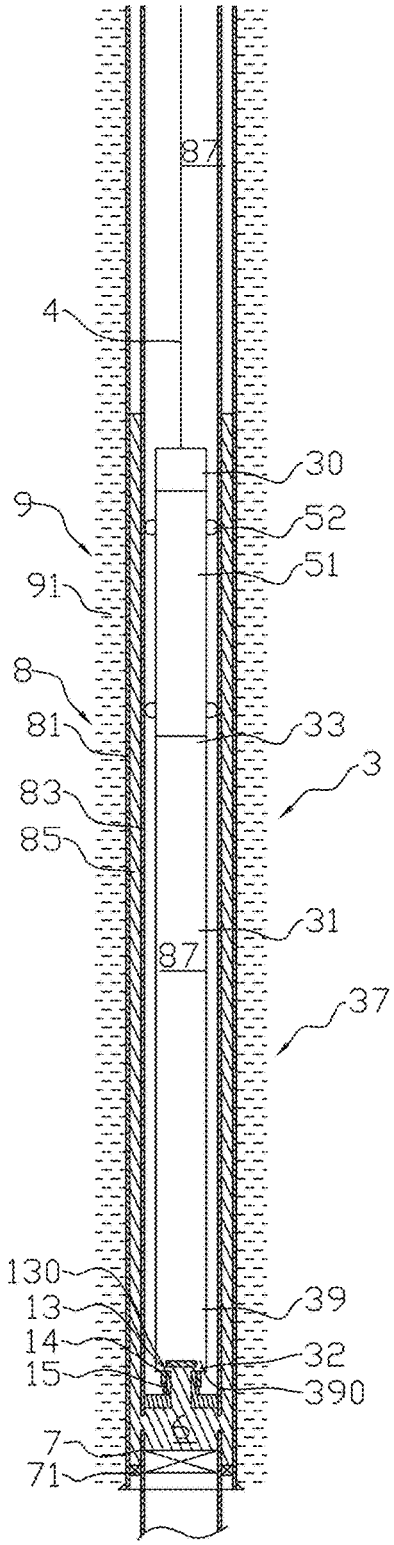

After the valve 1 has been opened by the tool 3, as shown in FIG. 5, the pump 33 is activated. The pump 33 fills the upper part of the compartment with the well fluid 87, and the force on the fluid plugging material 6 opens the outlet valve 35 as shown in FIG. 12. The fluid plugging material 6 flows out through the outlet 32, and into the passage 11 through the entrance 110. As seen in FIG. 12, the contact face 390 abuts sealingly the landing face 130 and no fluid plugging material 6 enters on the upper face 20 of the landing packer 2. The fluid plugging material 6 flows into a space between the lower face 29 of the landing packer 2 and the bridge plug 7 and fills this space. The fluid plugging material 6 flows further through the opening 84 and into the A-annulus 85 as seen in FIG. 6. The fluid plugging material 6 fills the A-annulus 85 until the compartment 31 is emptied for fluid plugging material 6 as seen in FIG. 7.

The compartment may be provided with the wiper plug 36. The wiper plug 36 separates the fluid plugging material 6 from the well fluid 87 and secures purity of the fluid plugging material 6.

Figure 8:
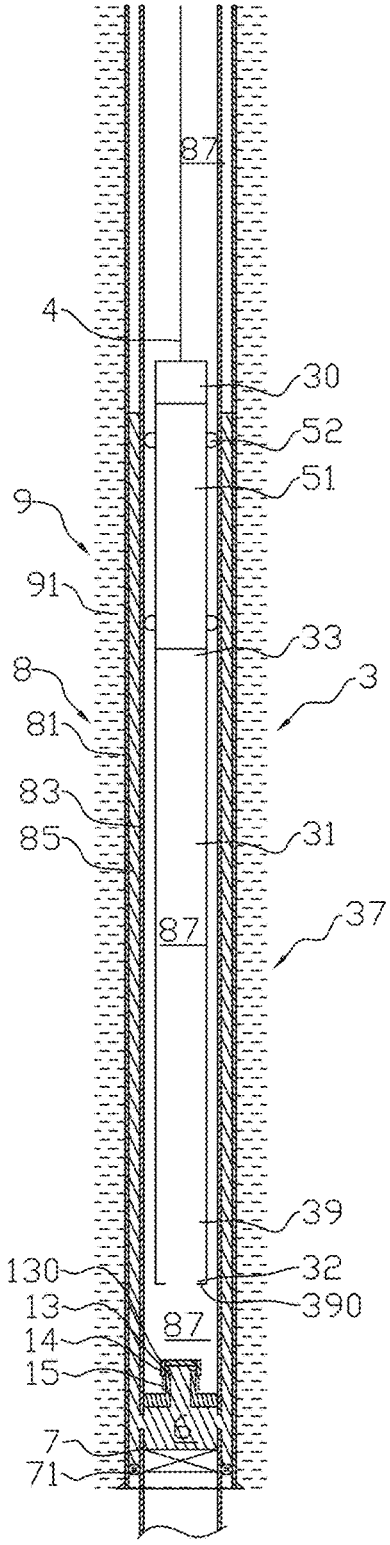

The tool 3 may be provided with a sensor (not shown) that monitor the content of the compartment 31. When the sensor report that the compartment 31 is empty of fluid plugging material 6, the pump 33 stops. The pump 33 may also be a calibrated pump such that the pump 33 stops when a known volume of fluid plugging material 6 has been forced out of the compartment 31. If a wiper plug 36 is used, the pump 33 stops when the wiper plug 36 lands on the outlet valve 35. After stopping the pump 33, the tool 3 is withdrawn. The biased valve body 13 returns to a closed position as shown in FIG. 8.

Figure 9:
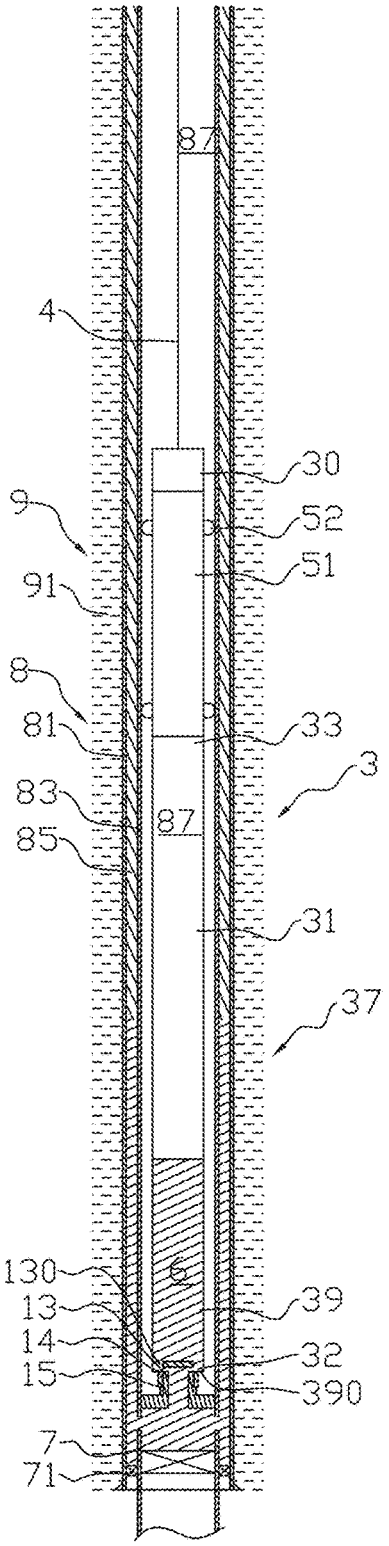
Figure 10:
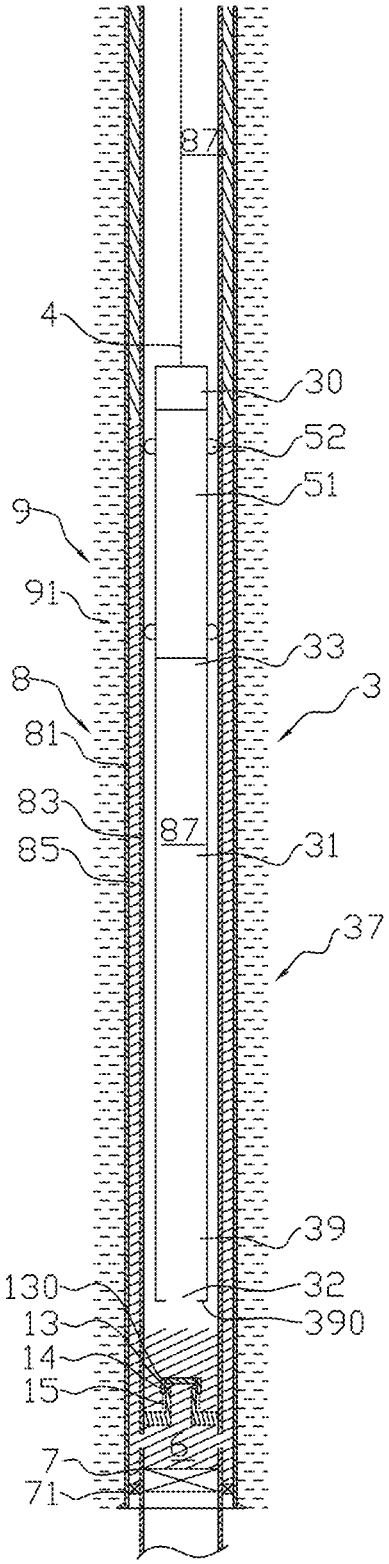

The tool 3 returns to the surface and more fluid plugging material 6 may be filled into the compartment 31. Thereafter the procedure of landing the tool 3 on the valve 1 and pumping more fluid plugging material 6 into the A-annulus is repeated as seen in FIG. 9. This procedure may be repeated until a desired quantity of fluid plugging material 6 has entered the A-annulus. When this has been achieved, the tool is lifted off the valve 1. Cement bond logging (CBL) after cementing of the A-annulus will quality check the cementing operation, i.e., the bonding and the height of the cement column placed in the A-annulus. Plugging of the production tubing 83 may then be completed by returning the tool 3 to the surface, filling more fluid plugging material 6 in the compartment 31, and descending the tool 3 into the wet fluid plugging material 6 above the valve 1 to avoid mixing the fluid plugging material 6 with the well fluid 87. The tool 3 is slowly withdrawn while fluid plugging material 6 is released from the tool (not shown). This procedure is repeated until a plugging column of desired height is built within the production tubing 83.

The method describes secures that the fluid plugging material 6 is not mixed with well fluid 87 in the A-annulus 85 and not mixed with well fluid 87 in the production tubing 83. Thereby, a plug of pure fluid plugging material 6 is built in both the A-annulus 85 and the production tubing 83.

In case the pump 33 cannot deliver sufficient pressure to force the fluid plugging material 6 into the A-annulus 85, the method may in one embodiment comprise to increase the pressure of the well fluid 87 within the production tubing 83 above the landing packer 2. It is known in the art how the pressure of the well fluid 87 can be increased from an operation on the surface. The increased pressure within the production tubing 83 will not open the valve 1. After the tool 3 has landed on the landing packer 2 and opened the valve 1, the increased pressure in the production tubing 83 above the landing packer 2 will assist the pump 33. The increased pressure of the well fluid 87 increases the pressure on the suction side of the pump 33 and the combined force created by the pump 33 and the fluid pressure forces the fluid plugging material 6 into the A-annulus 85.

The volume of fluid plugging material 6 placed within the A-annulus 85 can be verified by measuring the return of liquid from the A-annulus 85 at surface when the fluid plugging material 6 is squeezed into the A-annulus 85.

In embodiments where the fluid plugging material 6 consists of cement, the quality of the barrier column in the A-annulus 85 may be logged with a Cement bond logging measurement. The bond between the casing 81 and the cement or the integrity of the cement column can then be verified.

The B-annulus (not shown) can be cemented with the same technique as when cementing the A-annulus 85. The first step is to cement the A-annulus 85 to a desired height as described above. After the A-annulus 85 is cemented and the quality approved, a punching tool (not shown) is run to a target area. The punching tool punches holes through the production tubing wall, the cement within the A-annulus, and a casing wall into the B-annulus. After performing a clean-up sequence where liquid cleaning fluid is pumped down the production tubing 83 through the punched holes and up B-annulus, a new landing packer 2 is installed above the punched holes in the production tubing 83. The cementing procedure described for cementing the A-annulus 85 is repeated until sufficient cement is squeezed into the B-annulus.

The volume of cement squeezed into B-annulus can be measured at the surface. A Cement bond logging measure could be run to verify integrity of the cement column in the B-annulus.

A PC pump is suited as a pump 33 (progressive cavity pump; Moineau pump). In preferred embodiments the pump 33 will be a PC pump. The PC pump 33 is the driving force for pushing fluid plugging material 6 out of the compartment 31 and into the different sections to be cemented. A positive effect of utilizing the PC pump 33 is the vibrations generated by the helical rotor of the PC pump. The vibrations are transmitted as vibrations onto the production tubing 83 and lead to better cement bonding by minimizing micro-annulus especially where the production tubing 83 is closed or in contact with the casing 81.

In areas where the production tubing 83 touches the casing 81, insufficient bonding may occur between the production tubing 83, the cement 6, and the casing 81 after cementing the A-annulus 85. As a result, micro-annuli are created, and the quality of the P&A barrier is unacceptable. Running a wireline dimple tool (not shown) and dimple the production tubing 83 between tubing joint collars (not shown) will lift the production tubing 83 away from an internal surface of the casing 81 and create space for the cement. Such a wireline dimple tool is not described any further in relation to the present described wireline P&A cementing procedure.

In an alternative embodiment (not shown) a dedicated vibration tool (not shown) is positioned close to the plugging area within the production tubing 83. The vibration tool vibrates the production tubing 83. In an alternative, the whole production tubing 83 is vibrated from the surface. The vibrating production tubing 83 assists in complete filling of the A-annulus 85 with cement. Such a vibration technique is not described any further in relation to the present described wireline P&A cementing procedure.

The cementing operation of the A-annulus may meet unforeseen obstacles and the operation may be paused or halted. The cement cures before a sufficient amount of cement has been pumped into the A-annulus 85. A restart of A-annulus cementing operation is possible. Steps of the restart procedure may be:

Establish status on work already performed;

Check cement bonding in the A-annulus 85 as described above; and

Verify filling height of the cement column in the A-annulus 85;

Punch holes in the production tubing wall close to the cement column top;

Verify free circulation down the production tubing 83 and up the A-annulus 85;

Dump cement above the landing packer 2 in the production tubing 83 until the top of the cement is just below the newly punched hole;

Install new landing packer 2 within the production tubing 83 and above the top of the cement; and Continue the A-annulus cementing operation till approved cement column is in place.

When the approved column is in place in the A-annulus 85, the cementing operation in the production tubing 83 is completed.

Figure 13:
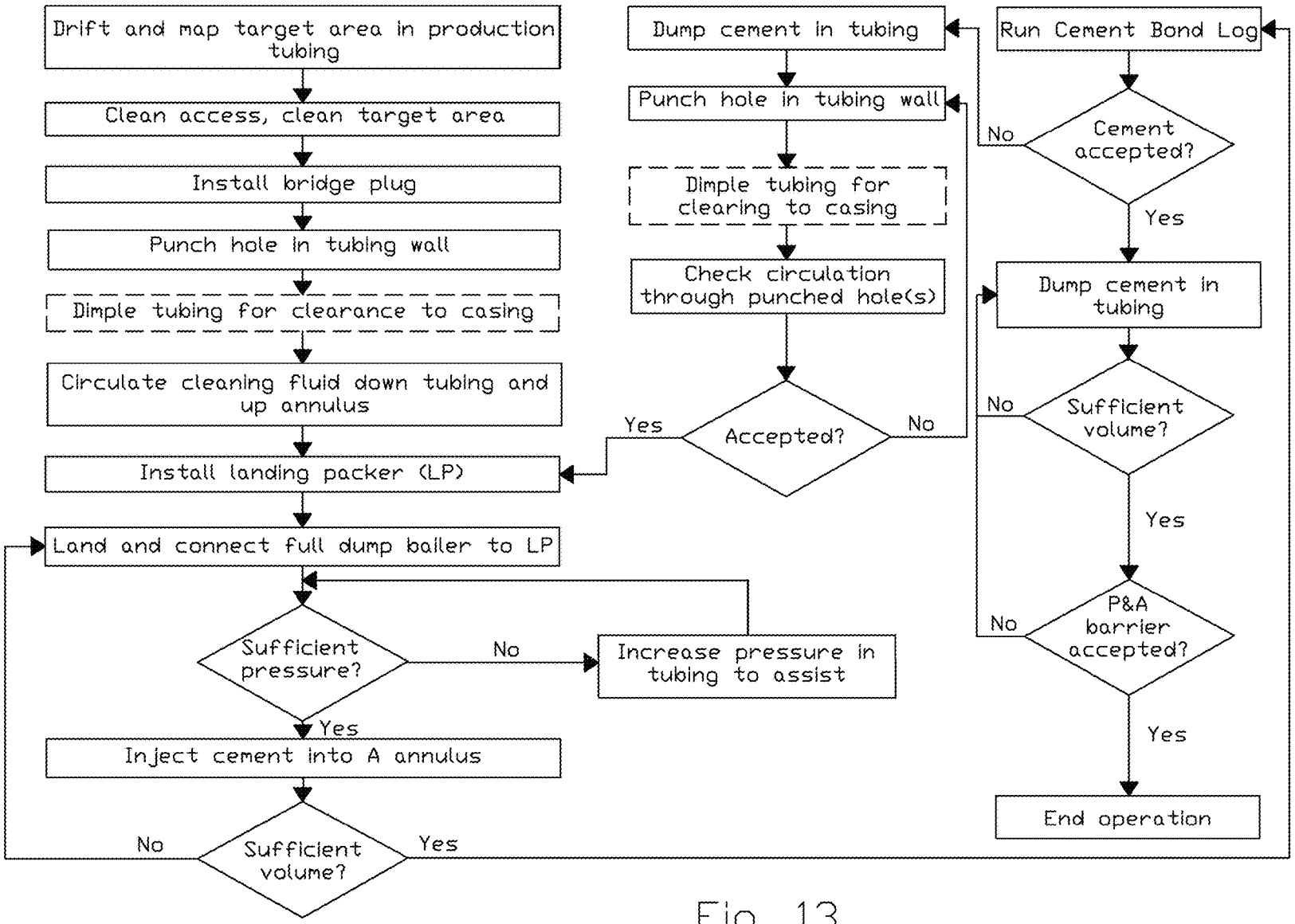
FIG. 13 shows a flow chart of a wireline operated plugging operation according to the invention.

FIG. 13 shows an overview of the method for plugging the A-annulus according to the invention and for establishing an approved P&A barrier in one or more annuli and the tubing.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

What is claimed:

1. A system for plugging a petroleum well with a fluid plugging material, wherein the system comprises:

a valve for a landing packer adapted for forming a bridge plug in the petroleum well, the landing packer provided with a passage between an upper face and a lower face, the valve adapted to close the passage, and a tool adapted for displacement in the petroleum well, wherein:

the tool comprises a leading end;

the tool comprises an internal compartment adapted to house and release the fluid plugging material;

the valve comprises a biased valve body adapted to be displaced between a first position and a second position; wherein in the first position, the valve body closes liquid tight an entrance to the passage, and in the second position, the entrance is open;

the valve body is adapted to receive the tool from above;

the valve body is adapted to be displaced from the first position to the second position by a downward force executed by the tool;

the valve body is adapted to be displaced to the first position when the downward force executed by the tool is removed; and the tool is adapted to abut fluid tightly the biased valve body, and to displace the biased valve body between a first closed position and a second open position by the downward force executed by the tool.

2. The system according to claim 1, wherein the valve body comprises a sleeve.

3. The system according to claim 1, wherein the valve comprises a spring biasing the valve body towards the first position.

4. The system according to claim 1, wherein the leading end is adapted to form a liquid tight connection between the internal compartment and the passage in the landing packer via an outlet in the leading end and an entrance in the valve.

5. The system according to claim 1, wherein the tool is:

operated by a wireline;

provided with a pump at an upper end;

provided with a fluid connection between a suction side of the pump and a surrounding of the tool; and provided with an outlet valve between the internal compartment and the outlet.

6. The system according to claim 5, wherein the internal compartment is provided with a wiper plug.

7. The system according to claim 5, wherein the outlet valve is a check valve.

8. The system according to claim 1, wherein the system further comprises a driving unit for displacement of the tool within the petroleum well.

* * * * *